US006290374B1

(12) United States Patent
Shieh et al.

(10) Patent No.: US 6,290,374 B1
(45) Date of Patent: Sep. 18, 2001

(54) TRAFFIC SIGNAL LAMP ILLUMINATED BY LIGHT EMITTING DIODES

(75) Inventors: Han-Ping Shieh, Hsinchu; Chong-Min Chang, Taipei; Keng-Han Chuang, Kaohsiung; Ju-Yuan You, Hsinchu; Chung-Jung Chen, San-Chung, all of (TW)

(73) Assignee: Opto Tech Corp., Hsinchu (TW)

( * ) Notice: Subject to any disclaimer, the term of this patent is extended or adjusted under 35 U.S.C. 154(b) by 0 days.

(21) Appl. No.: 09/602,698

(22) Filed: Jun. 24, 2000

(51) Int. Cl.[7] ..... F21V 5/00
(52) U.S. Cl. ..... 362/333; 362/331
(58) Field of Search ..... 362/331, 332, 362/333, 336, 337, 334, 311

(56) References Cited

U.S. PATENT DOCUMENTS 4,120,018 * 10/1978 Nagel ..... 362/333
4,158,222 * 6/1979 Cook ..... 362/333 X
5,055,976 * 10/1991 Aria ..... 362/334 X
5,584,570 * 12/1996 Binder et al. ..... 362/333 X

* cited by examiner

*Primary Examiner*—Laura K. Tso

(57) ABSTRACT

A traffic signal lamp includes a plurality of light emitting diodes and two lens sets. A first lens set has an entrance surface comprising a plurality of convex cylindrical surfaces running in a vertical direction and an exit surface comprising a plurality of slanted surface segments running in a horizontal direction. A second lens set has an entrance surface comprising a plurality of elongated concave cylindrical surfaces running in the vertical direction and an convex exit surface having a small curvature. The first lens set collimates light in the horizontal direction and limits light in a viewing angle in the vertical direction. The second lens set redistributes light uniformly in a viewing angle in the horizontal direction.

7 Claims, 5 Drawing Sheets

TRAFFIC SIGNAL LAMP ILLUMINATED BY LIGHT EMITTING DIODES

FIELD OF THE INVENTION

The present invention relates to a refractive lens system, and more particularly to a refractive lens system illuminated by light emitting diodes for traffic signal lamps.

BACKGROUND OF THE INVENTION

A traffic signal lamp is used to control vehicles and passengers so that traffic can flow smoothly and both drivers and passengers are safe. Brightness and viewing angle are two important requirements that have to be considered in manufacturing a traffic signal lamp. Most countries require very high brightness and limited viewing angle for traffic signal lamps. In general, there should be no brightness above the horizontal line of a traffic signal lamp. The primary light source of a conventional traffic signal lamp has been an incandescent lamp.

In recent years, light emitting diodes are gradually used to replace the incandescent lamp. However, it has been difficult to design traffic signal lamps illuminated by light emitting diodes to satisfy the brightness and viewing angle requirements. One conventional approach to manufacturing a traffic signal lamp illuminated by light emitting diodes is to use a large number of diodes without adding any lens. Because light is emitted towards all directions from the diodes, the illumination above the horizontal viewing angle is completely wasted. In order to satisfy the brightness, many light emitting diodes are required in this approach.

To reduce the number of light emitting diodes required and limit the viewing angle, some manufacturers have tried to add lenses in front of the light emitting diodes. Nevertheless, it is difficult to design high efficiency lens that can greatly increase the brightness of a traffic signal lamp. Most of the design still requires a fairly large number of light emitting diodes. With some complex lens design, it may require a less number of light emitting diodes. However, complex lens design makes the manufacturing difficult and the cost of a lamp too high.

As described above, the conventional approaches to manufacturing traffic signal lamps can not meet the objectives of saving energy and reducing cost. There is a strong need in designing traffic signal lamps illuminated by light emitting diodes that meet the requirements of high brightness, desired viewing angle, and low power consumption.

SUMMARY OF THE INVENTION

The present invention is designed to overcome the above-mentioned drawbacks in manufacturing the conventional traffic signal lamps. A primary object of the present invention is to provide a high brightness but limited viewing angle traffic signal lamp illuminated by light emitting diodes. Accordingly, the traffic signal lamp of this invention comprises two lens sets. A first lens set collimates light emitted from light emitting diodes in a horizontal direction and limits light in a viewing angle in a vertical direction. A second lens set redistributes the light within a viewing angle in the horizontal direction.

It is also an object of the invention to provide the design of a lens set that can collimate light in a horizontal direction and limit light angle in a vertical direction. The first lens set of the traffic signal lamp has an entrance surface comprising a plurality of convex cylindrical surfaces in the vertical direction and an exit surface comprising a plurality of slanted planar or cylindrical surface segments in the horizontal direction. The convex cylindrical surfaces collimate light into parallel light in the first lens set in the horizontal direction. The slanted surface segments limit light in a viewing angle in the vertical direction.

It is yet another object of the invention to provide the design of a lens set that can redistribute and limit light in a viewing angle in the horizontal direction. The second lens set of the traffic signal lamp has an entrance surface comprising a plurality of elongated concave cylindrical surfaces in the vertical direction and a convex exit surface with a small curvature. Light passing through the first lens set is redistributed and limited by the second lens set in a viewing angle in the horizontal direction uniformly.

Another object of the invention is to provide lens sets that are low cost and easy to manufacture. According to the invention, the first and second lens sets have simple cylindrical or planar surfaces that can be manufactured without difficulty. At least one of the convex cylindrical surfaces of the first lens set can be a recessed cylindrical surface to reduce the thickness as well as the cost of the first lens set. The light transmission through the first lens set is also increased.

Other features and advantages of the invention will become better understood from the following description of the invention which refers to the accompanying drawings.

DESCRIPTION OF THE PREFERRED EMBODIMENTS

Figure 1:
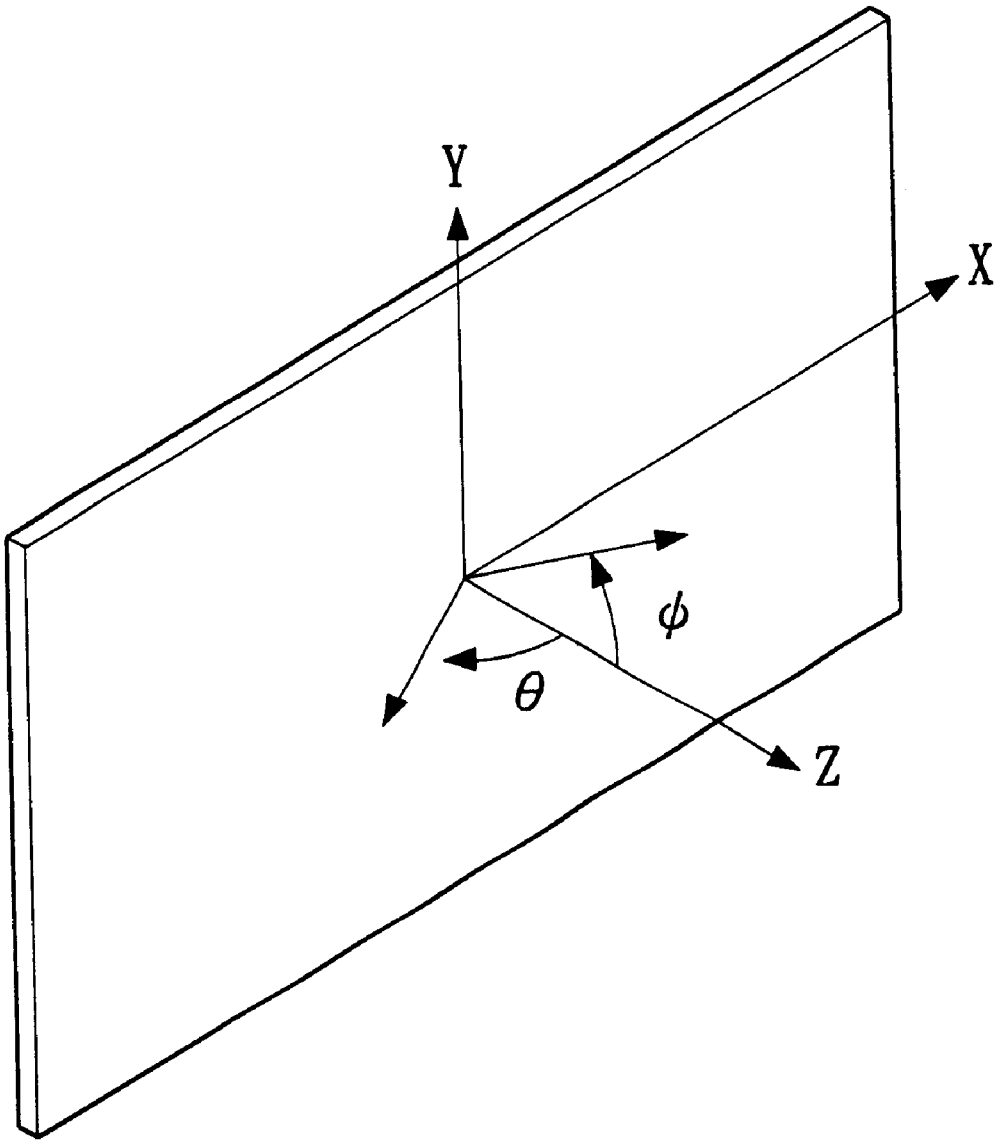
FIG. 1 illustrates the coordinate system used to describe the lens sets of the present invention.

For the convenience of describing the preferred embodiments, a few terms used throughout the specification will be defined first. As shown in FIG. 1, the propagation direction after the light is emitted from a light source is defined as the positive Z-axis which is also called an optical axis. The plane perpendicular to the optical axis is defined as X-Y plane. The viewing angle is defined as the angle formed by the optical axis and a viewer facing the light source. The angle $\theta$ in FIG. 1 is the horizontal viewing angle, which is the angle formed by the optical axis and the line from the light source to the viewer in the horizontal direction. The angle $\phi$ in FIG. 1 is the vertical viewing angle, which is the angle formed by the optical axis and the line from the light source to the viewer in the vertical direction.

Figure 2:
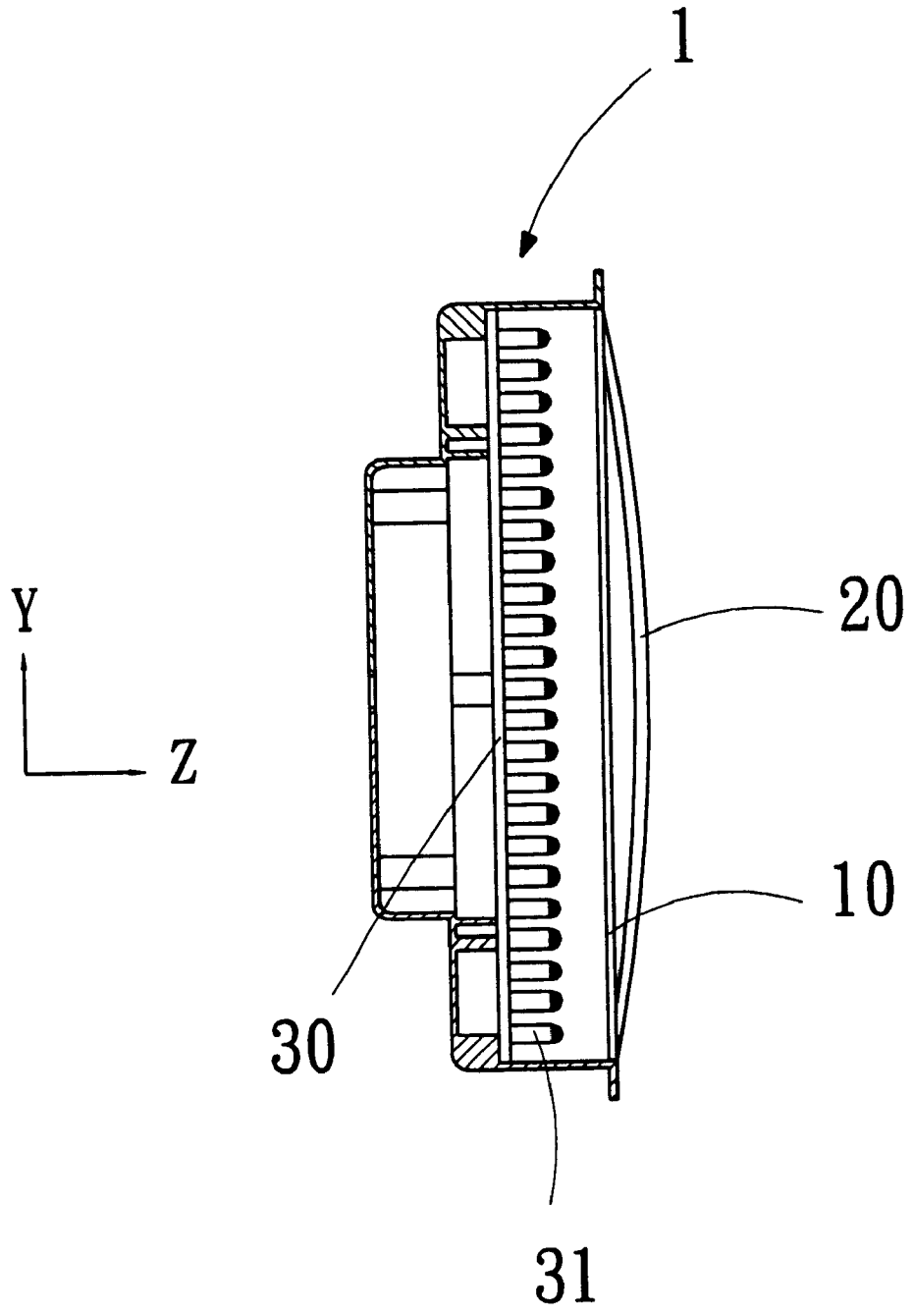
FIG. 2 shows a cross-sectional view of the traffic signal lamp in accordance with the present invention.

As illustrated in FIG. 2, a cross-sectional view of the traffic signal lamp according to the present invention is shown. The traffic signal lamp 1 has an illumination source 30 comprising a plurality of light emitting diodes 31. A first lens set 10 is positioned in front of the illumination source 30 in the positive Z-axis direction. A second lens set 20 next to the first lens set is also positioned in the positive Z-axis direction.

Figure 3:
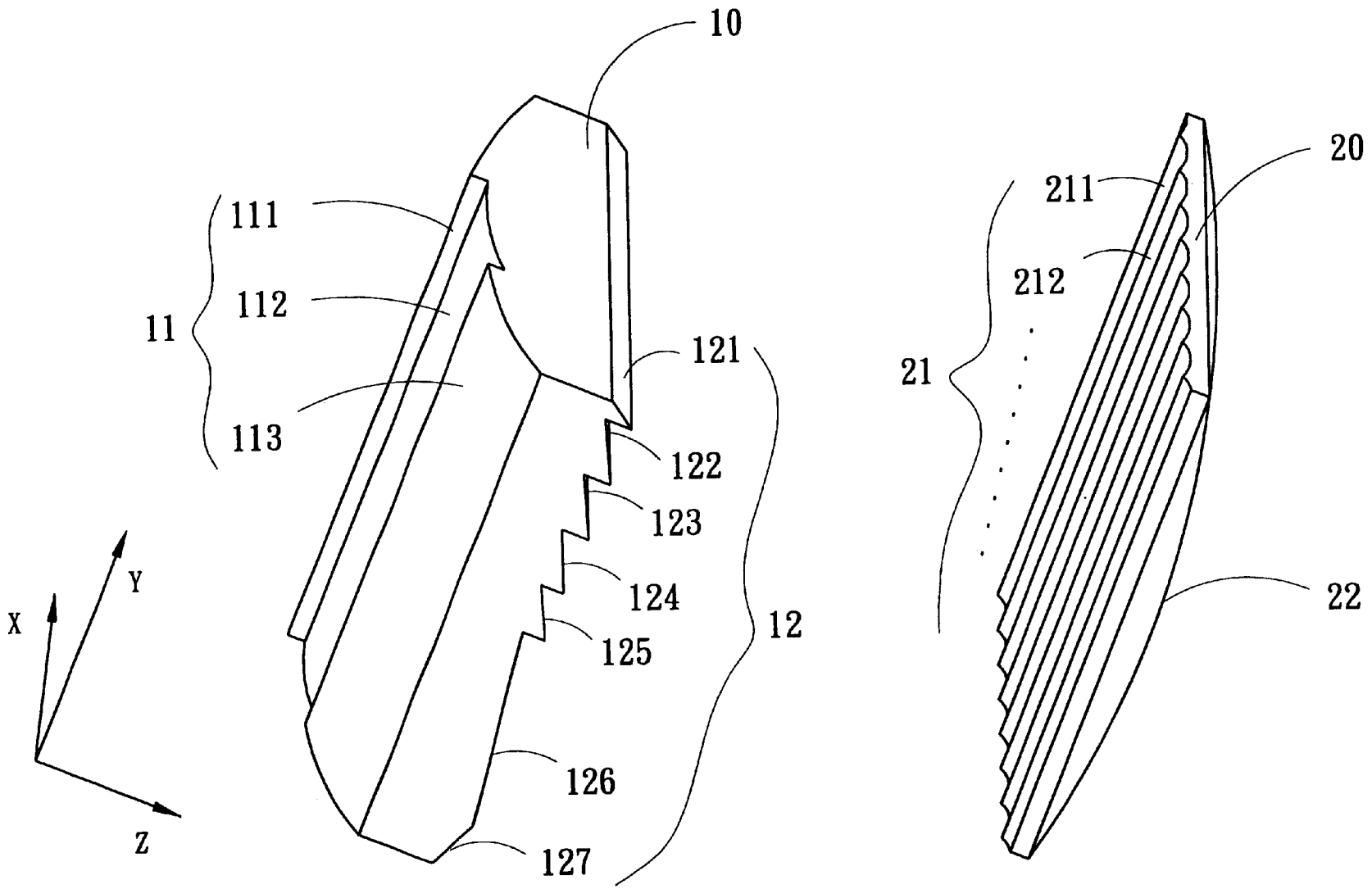
FIG. 3 shows three-dimensional perspective views of the first and second lens sets used in the traffic signal lamp of the present invention.

FIG. 3 shows the decomposed three-dimensional view of the two lens sets 10 and 20. On the left side of FIG. 3 is the three-dimensional view of the first lens set. The entrance surface 11 of the first lens set 10 consists of a plurality of convex cylindrical surfaces 111, 112, and 113 running in the Y-axis direction. The purpose of the convex cylindrical surfaces is to converge the light emitted horizontally from the diodes into parallel light. By having a couple of convex cylindrical surfaces 111, 113 with a recessed convex cylindrical surface 112 in the middle of the lens set as shown in FIG. 3, the thickness of the lens set can be greatly reduced. The light transmission efficiency through the lens set is therefore increased. The cost of manufacturing the lens set is also decreased.

Figure 4A:
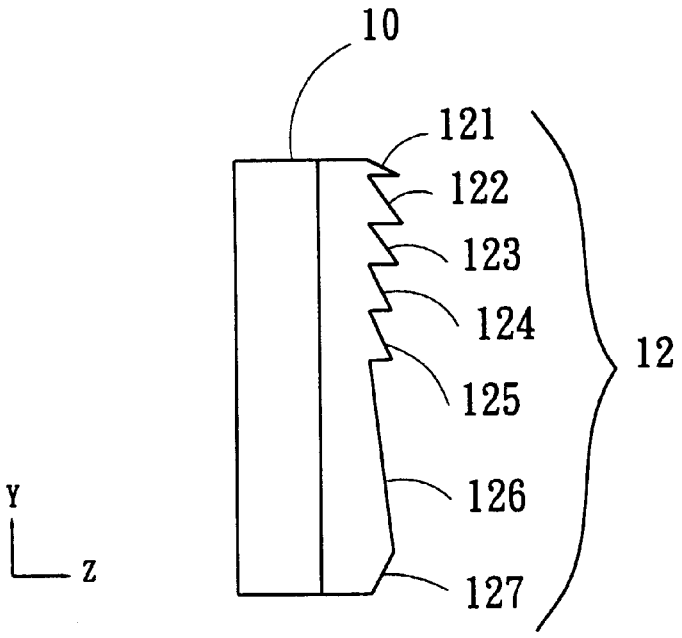
FIG. 4A shows the cross-sectional view of a first embodiment of the first lens set of the present invention in the Y-Z plane.
Figure 4B:
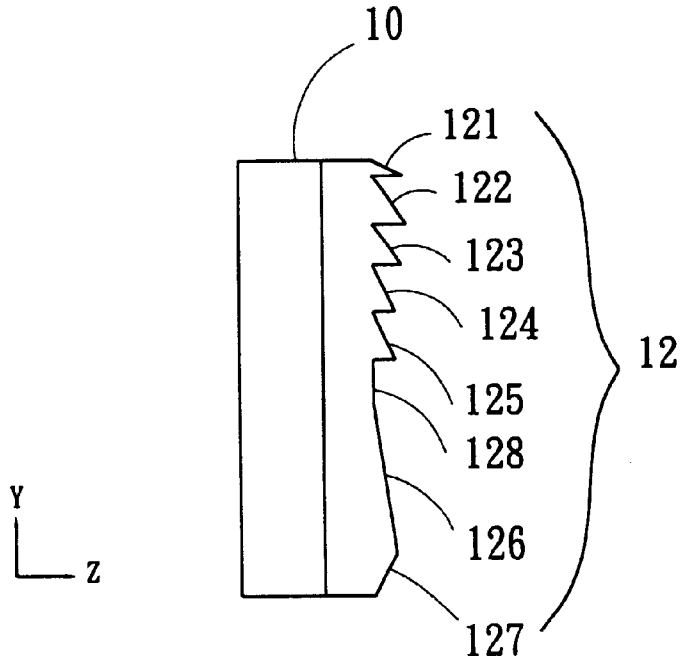
FIG. 4B shows the cross-sectional view of another embodiment of the first lens set of the present invention in the Y-Z plane.

The exit surface 12 of the first lens set consists of a plurality of slanted planar surface segments running in the X-axis direction. The planar surface segments may also be replaced by cylindrical surface segments. The exit surface 12 is divided as an upper portion and a lower portion. The function of the upper portion is to refract the light that enters the first lens set and goes up into a desired vertical viewing angle. The upper portion includes the surface segments 121, 122, 123, 124 and 125. The function of the lower portion is to refract the light that enters the first lens set and goes down into a desired vertical viewing angle. The lower portion includes the surfaces 126 and 127. FIG. 4A shows the cross-sectional view of the first lens set. A middle portion that passes light entering the first lens set without refraction may be manufactured between the upper and lower portions. FIG. 4B shows the middle portion comprising a non-slanted planar surface segment 128.

The right side of FIG. 3 shows a three-dimensional view of the second lens set 20. The entrance surface 21 of the second lens set 20 comprises a plurality of elongated concave cylindrical surfaces 211, 212, . . . , running in the Y-axis direction. The function of the entrance surface is to redistribute the light emitted horizontally into a desired horizontal viewing angle. The exit surface 22 of the second lens set is a convex surface having a small curvature.

Figure 5A:
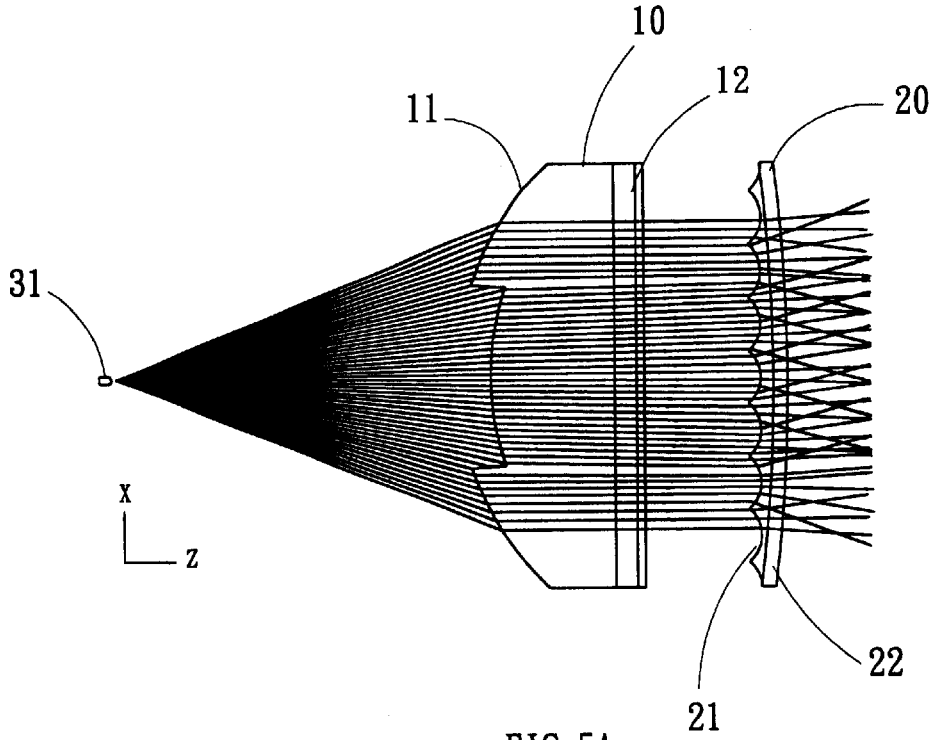
FIG. 5A shows the cross-sectional view of light propagation through first and second lens sets of the present invention in the X-Z plane.

Although a plurality of light emitting diodes are used in the traffic signal lamp of this invention, the principle of how the first and second lens sets work can be understood by studying the light rays emitted from a single diode as shown in FIGS. SA and 5B. FIG. 5A shows a cross-sectional view in the X-Z plane. A light emitting diode 31 is located in the focal plane of the entrance surface 11 of the first lens set 10. The light emitted from the light emitting diode 31 enters the entrance surface 11 and is converged by the convex cylindrical surfaces into parallel light in the Z-axis direction. The parallel light then passes through the exit surface 12 and is redistributed within a desired horizontal viewing angle by the entrance surface 21 of the second lens set 20. The redistributed light finally exits the exit surface 22 of the second lens set 20. Because of the redistribution, the light appears like it is coming from a uniform illumination source.

Figure 5B:
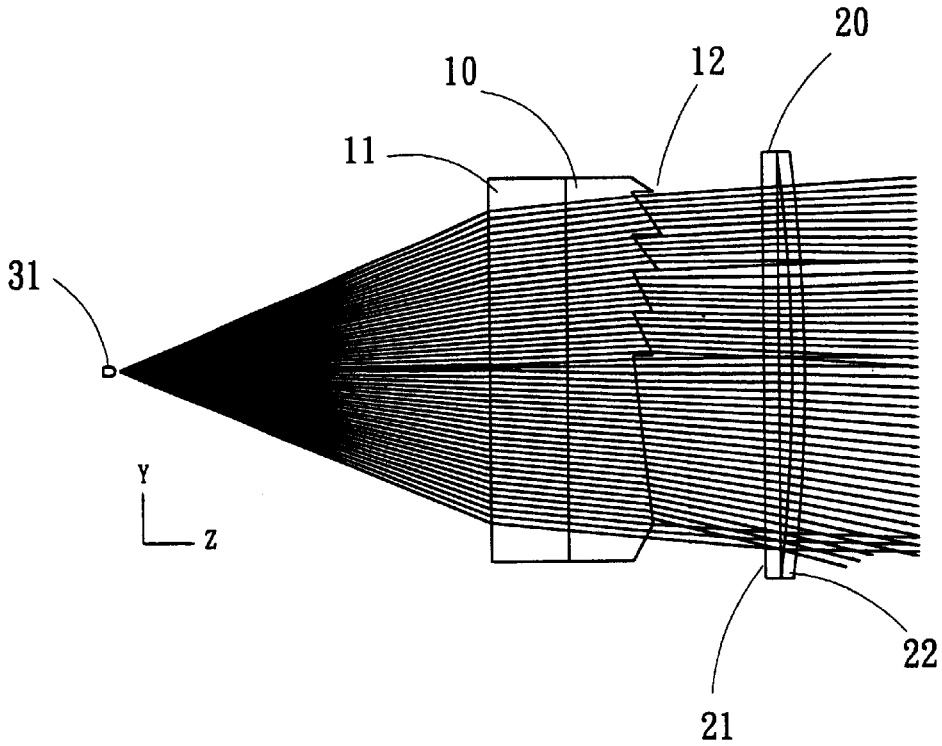
FIG. 5B shows the cross-sectional view of light propagation through first and second lens sets of the present invention in the Y-Z plane.

FIG. 5B shows a cross-sectional view in the Y-Z plane. The light emitted from a light emitting diode 31 enters the entrance surface 11 of the first lens set 10 and is refracted into a narrower range. The planar surface segments in the upper portion of the exit surface 12 further refract and bend down the light that goes up into a desired vertical viewing angle. The planar surface segments in the lower portion of the exit surface 12 further refract the light into the desired vertical viewing angle. The light then enters and passes through the second lens set 20. Consequently, the light is limited within the desired viewing angle in the vertical direction and there is no brightness above the horizontal line of the traffic signal lamp.

In summary, the first lens set 10 collimates the light in the horizontal direction and limits the light within a viewing angle in the vertical direction. The second lens set 20 redistributes the light uniformly within the desired viewing angle. The exit surface 22 of the second lens set 20 is a convex surface with a small curvature which can also prevent the traffic signal lamp from accumulating dust.

Although only the preferred embodiments of this invention were shown and described in the above description, numerous changes in the detailed construction and combination as well as arrangement of parts may be restored to without departing from the spirit or scope of the invention as hereinafter set forth in the appended claims. It is requested that any modification or combination that comes within the spirit of this invention be protected.

What is claimed is:

1. An optics apparatus comprising:

a light source;

a first lens set having an entrance surface comprising a plurality of convex cylindrical surfaces in a vertical direction and an exit surface comprising a plurality of slanted surface segments in a horizontal direction, said first lens set being positioned in front of said light source for collimating light from said light source and limiting light illumination angle within a desired viewing angle; and a second lens set having an entrance surface comprising a plurality of elongated concave cylindrical surfaces in said vertical direction and a convex exit surface, said second lens set being positioned in front of said first lens set for redistributing light passing through said first lens set within a desired viewing angle.

2. The optics apparatus according to claim 1, wherein at least one of said plurality of convex cylindrical surfaces of said entrance surface of said first lens set is a recessed convex cylindrical surface.

3. The optics apparatus according to claim 1, said light source comprising a plurality of light emitting diodes.

4. The optics apparatus according to claim 1, said light source being located near a focal plane of said first lens set.

5. The optics apparatus according to claim 1, each of said plurality of slanted surface segments of said first lens set being a planar surface segment or a cylindrical surface segment.

6. The optics apparatus according to claim 1, said plurality of slanted surface segments being divided into an upper portion for bending down light emitted upwards through said first lens set, and a lower portion for refracting light emitted downwards through said first lens set into a desired viewing angle.

7. The optics apparatus according to claim 6, said exit surface of said first lens set further comprising a middle portion having at least one planar surface segment between said upper portion and said lower portion for passing light emitted through said first lens set without refraction.

* * * * *